United States Patent [19]

Lester

[11] 3,998,045

[45] Dec. 21, 1976

[54] TALKING SOLID STATE TIMEPIECE

[75] Inventor: Robert W. Lester, Manhasset, N.Y.

[73] Assignee: Camin Industries Corporation, New York, N.Y.

[22] Filed: June 9, 1975

[21] Appl. No.: 584,874

[52] U.S. Cl. ..... 58/23 R; 179/1 SM; 179/7.1 R

[51] Int. Cl.[2] ..... G04C 3/00

[58] Field of Search ..... 58/14, 23 R, 57; 179/1 SM, 7.1 R; 360/12

[56] References Cited

UNITED STATES PATENTS

| | | | |
|---|---|---|---|
| 3,356,836 | 12/1967 | Stenbt | 179/1 SM |
| 3,376,551 | 4/1968 | Armbruster | 340/172.5 |
| 3,641,496 | 2/1972 | Slavin | 179/1 SM |
| 3,644,682 | 2/1972 | Parilla | 179/100.1 C |
| 3,870,818 | 3/1975 | Barton | 179/1 SM |
| 3,892,919 | 7/1975 | Ichikawa | 179/1 SM |
| 3,919,834 | 11/1975 | Murakami | 58/57.5 |
| 3,938,317 | 2/1976 | Spano | 58/23 R |

OTHER PUBLICATIONS

"Electronics", Oct. 31, 1974, pp. 27–28.

*Primary Examiner*—L. T. Hix
*Assistant Examiner*—Vit W. Miska
*Attorney, Agent, or Firm*—Pennie & Edmonds

[57] ABSTRACT

The talking timepiece which, in one form, will have all the same characteristics and appearance of an ordinary wrist watch, but with the read-out a spoken tone, which will actually give the time to the nearest minute, in a voice composed from sufficient information bits to be reasonably faithful reproduction of either the owner's voice, or the voice of a person of his selection, this done in any language with or without extraneous other information.

4 Claims, 15 Drawing Figures

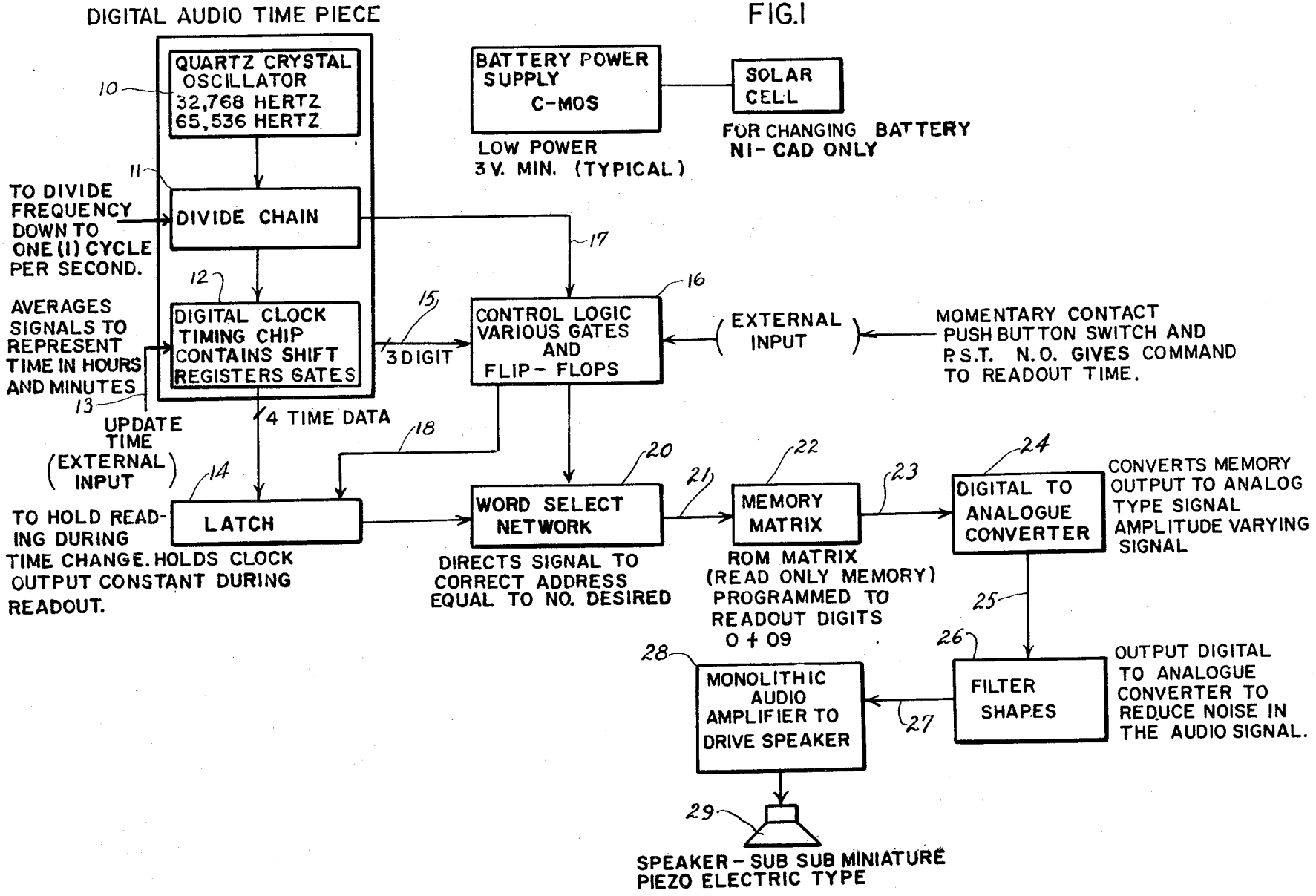
FIG.1
DIGITAL AUDIO TIME PIECE
QUARTZ CRYSTAL OSCILLATOR 32,768 HERTZ 65,536 HERTZ
DIVIDE CHAIN
DIGITAL CLOCK TIMING CHIP CONTAINS SHIFT REGISTERS GATES
LATCH
TO DIVIDE FREQUENCY DOWN TO ONE (1) CYCLE PER SECOND.
AVERAGES SIGNALS TO REPRESENT TIME IN HOURS AND MINUTES
UPDATE TIME (EXTERNAL INPUT)
TO HOLD READING DURING TIME CHANGE. HOLDS CLOCK OUTPUT CONSTANT DURING READOUT.
3 DIGIT
4 TIME DATA
BATTERY POWER SUPPLY C-MOS
LOW POWER 3V. MIN. (TYPICAL)
SOLAR CELL
FOR CHANGING BATTERY NI-CAD ONLY
EXTERNAL INPUT
MOMENTARY CONTACT PUSH BUTTON SWITCH AND P.S.T. N.O. GIVES COMMAND TO READOUT TIME.
CONTROL LOGIC VARIOUS GATES AND FLIP-FLOPS
WORD SELECT NETWORK
DIRECTS SIGNAL TO CORRECT ADDRESS EQUAL TO NO. DESIRED
MEMORY MATRIX
ROM MATRIX (READ ONLY MEMORY) PROGRAMMED TO READOUT DIGITS 0 + 09
DIGITAL TO ANALOGUE CONVERTER
CONVERTS MEMORY OUTPUT TO ANALOG TYPE SIGNAL AMPLITUDE VARYING SIGNAL
FILTER SHAPES
OUTPUT DIGITAL TO ANALOGUE CONVERTER TO REDUCE NOISE IN THE AUDIO SIGNAL.
MONOLITHIC AUDIO AMPLIFIER TO DRIVE SPEAKER
SPEAKER - SUB SUB MINIATURE PIEZO ELECTRIC TYPE
10
11
12
13
14
15
16
17
18
20
21
22
23
24
25
26
27
28
29

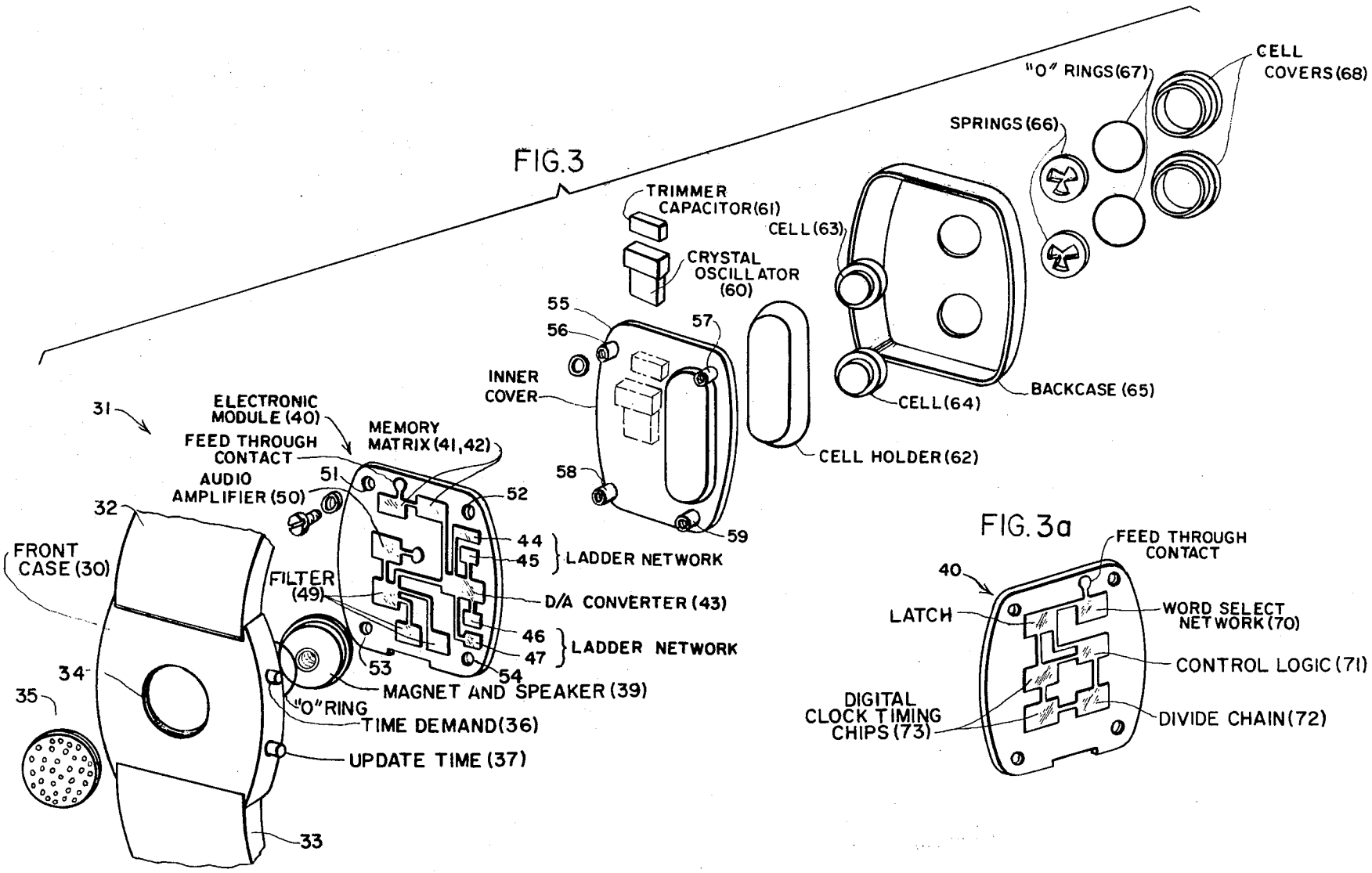
CELL COVERS (68)
"O" RINGS (67)
SPRINGS (66)
BACKCASE (65)
CELL (64)
CELL HOLDER (62)
CELL (63)
TRIMMER CAPACITOR (61)
CRYSTAL OSCILLATOR (60)
57
59
55
56
58
INNER COVER
LADDER NETWORK
D/A CONVERTER (43)
LADDER NETWORK
44
45
46
47
52
54
MEMORY MATRIX (41, 42)
53
51
ELECTRONIC MODULE (40)
FEED THROUGH CONTACT
AUDIO AMPLIFIER (50)
FILTER (49)
MAGNET AND SPEAKER (39)
"O" RING
TIME DEMAND (36)
UPDATE TIME (37)
33
31
32
34
35
FRONT CASE (30)
FIG. 3
FEED THROUGH CONTACT
WORD SELECT NETWORK (70)
CONTROL LOGIC (71)
DIVIDE CHAIN (72)
40
LATCH
DIGITAL CLOCK TIMING CHIPS (73)
FIG. 3a

TALKING SOLID STATE TIMEPIECE

BACKGROUND OF THE INVENTION

The wrist watch has proved itself a very practical, workable and, even, an ornamental device to the point that its popularity makes it virtually a universal appliance owned and worn by everyone. It has been refined to the highest imaginable state of precision in the form of thermometers and movements and the case has been refined to the finest expression of the jeweler's art. Unfortunately, there are many people who with the refinement in the appearance of the wrist watch lose the ability to read it, not because of the watch, but, simply, their vision loses acuity and the nominal markings, or the non-markings, in the faces of the more stylish watches are invisible to them. This has not been cured by the digital watches, because the problem is one of visibility and the loss of vision is not connected with the watch.

By translating the time signal to an audible one it is possible to give a time signal to the ear. This is done in architectual monuments and in some monuments to the watchmaker's art in the form of large grandfather type clocks. That is, the time signal is in terms of a ring and coded time signal which occurs at each quarter hour. Thus, the blind person after once observing the hour through the audible sounding of the bell can follow the time to within 15 minutes.

No device, however, exists in the art, particularly no device of wrist watch size exists in the art which would provide the user with an audible readout.

It is accordingly a basic object of this invention to provide a small personal timepiece for use by an individual which will tell the time audibly on demand to the nearest minute.

It is another object of the invention to provide a wrist watch in which the time readout is in the form of a spoken audible signal, available on demand by the user.

It is another object of the invention to provide a timepiece of a form such that it can be worn as part of a hearing aid and activated merely by finger pressure to give the user a time reading.

It is another object of the invention to provide a timepiece in form such that it can be used as tie tack, or pen, to give the time audibly on demand by the user, or wearer.

Other objects and advantages of the invention will in part be obvious and in part appear hereinafter.

A DETAILED DESCRIPTION OF THE INVENTION

This invention thus is a timepiece available in a form and size which can be worn as a wrist watch, or which can be mounted and worn as part of a hearing aid, and which can be worn and built in as part of the temple in stylish, relatively heavy framed spectacles, as well as pens or tie tacks.

Digital time pieces operating on closely controlled frequency from a crytal are a familiar device in the market and starting with a frequency source of that nature, powered by a small energy cell, coupled with an amplifier and timing chips and the like, employing it with a memory matrix all connected to a miniture audio amplifier, to drive a speaker, I have devised a means for having a quartz crystal oscillator function as the basic timekeeping unit for an audio speaker which will state the signal. In other words, by including in a miniture digital readout watch certain control logic network, selection, latch, memory, and analog converter with an amplifier, I am able to convert the time signal to a spoken signal which the user can hear.

Reference to the accompanying drawings will make possible a more detailed understanding of the invention. Therein, FIG. 1 is a block diagram of a digital audio wrist watch in accordance with my invention;

FIG. 3 is an exploded view of a wrist watch made in accordance with this invention, showing a physical arrangement of parts with approximate dimensions in producing a preferred embodiment of this invention;

Referring now to FIG. 1, the diagram is fundamentally self-explanatory.

The device can be made to function in many, or all, languages, and while we are talking essentially here in English, it is obvious that whatever is said about the English language is equally true when watches are being made for use in another culture. In other words, the watch can be adapted to any language.

A time signal can be adapted to be given in the usual twelve hour mode, with an a.m. and p.m. designation or it can be rendered in the 24 hour mode.

For the absent-minded, the timepiece can be programmed to give dates, because once set correctly it will keep time to plus or minus one minute per month, and, accordingly, permits programming with birthday reminders, or other important dates.

Figure 2A:
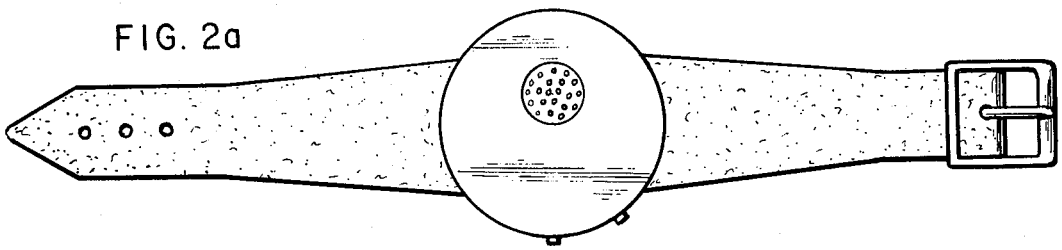
FIGS. 2 are watches.
Figure 2B:
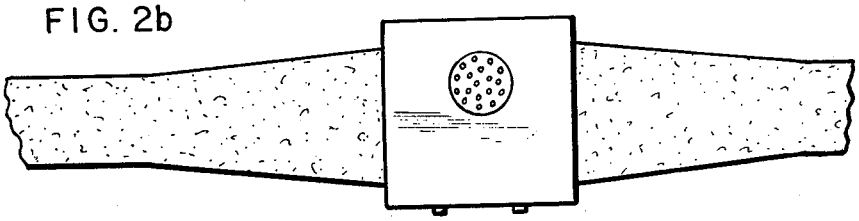
Figure 2C:
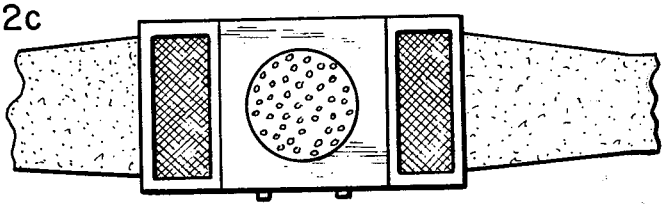
Figure 4:
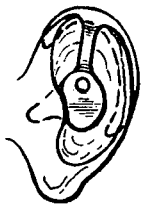
FIG. 4 is a hearing aid watch, harldy more than a wrist watch mounted in a mold suitable for fitting into the, or onto an, ear lobe.
Figure 5:
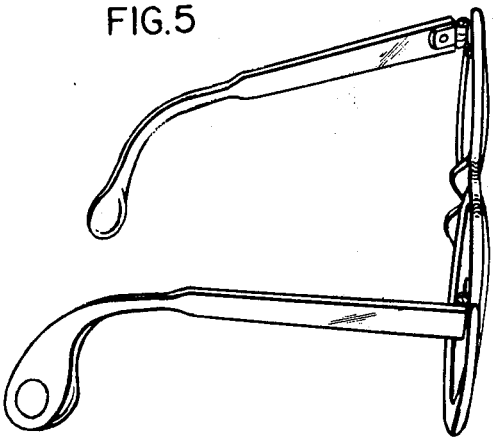
FIG. 5 is a view of a spectacle temple, showing the spread of parts in an area in which the parts are molded to form a temple suitable for mounting and placing the speaker adjacent to the skull for hearing by bone conduction.

The signal is applicable to watches, pens, clocks, eyeglasses, automobiles and telephones, but fundamentally the block diagram of FIG. 1 is visualized as being for a wrist watch with the control built therein, for conventional wrist use, that is, the parts are keyed to FIGS. 2 and 3, and by extension to FIG. 4 and 5, and the other applications indicated.

Referring now to FIG. 1, it will be observed that basic to the device is a quartz crystal oscillator, 10, which we have indicated specifically to have a frequency of 32,768 Hertz or double that, that is 65,536 Hertz. These are practical levels of frequency available commercially. The signal is fed from the oscillator, 10, to the divider chain, 11, to divide the frequency down to 1 cycle per second. From this, connection is made to digital clock timing chip, 12, which contains a chip to register the gates. This is the point where the signals are given to represent the time in hours and minutes and the external input, 13, is provided to update the time. These three units 10, 11 and 12 are the basic heart of the existing digital watches in use.

Connection is made from the timing chip, 12, to latch, 14, which holds the reading during the time change. This holds the clock output constant during a readout.

Connection is also made via 15, to control logic, various gates and flip-flops, 16, which are connected back to the latch. Connection is also made from the dividing chain via 17, to the control logic unit. From the control logic, connection 18, also feeds to the latch.

Signals are taken from control logic, 16, via connection 19, to the word select network, 20. Connection is made from the word select network via 21, to the memory matrix, 22, which is made to read only the memory programmed to readout digits from 0 to 9. The memory matrix feeds via line 23 to digital analogue converter, 24, which connects via the line, 25, to the filter shape selector, 26, via line, 27, to a monolithic audio amplifier, 28, to the speaker 29.

As with any block diagram, the system has validity only to the extent that it can be reduced to a physical entity, but as with block diagram, it shows graphically the manner in which I arrive at the spoken signal. The various elements of the block diagram are individually available, commercially, cheaply, in miniature, of a size such that they are easily mountable into a conventional wrist watch package no more than about 1½ inches in diameter and less ¼ inch thick. This we illustrate in FIG. 2.

A detailed commentary on the block diagram indicates that, for example, the latch, 14, is provided to hold a reading during a time change and holds the clock output constant during readout.

The memory matrix reads only the memory, which is programmed into it to read out the digits 0 – 9 and the digital analog converter, 24, converts the memory output to an analog type signal with amplitudes varying.

The following list of items indicates commercial units which I have used in the assembly of the wrist watch in accordance with the block diagram shown in FIG. 1, substantially in a geometric arrangement, as shown in FIG. 3, in exploded view. That is, the individual parts of FIG. 3 are actually magnified in scale and shaped to show how they are fitted into a unit.

In FIG. 3, the following is a type parts list:

2 — MOS LSI Clock Chips
1 — EVA Voice Unit
2 — Prototype Wirewrap Boards
Wirewrap Sockets
2 — Board Connectors
1 — Chassis
1 — Power supply (5v Logic)
1 — Power supply (ZOV MOS-Level)
1 — Wirewrap Gun and Wirewrap Wire
Assorted MSI and SSI Logic Chips
Assorted Mechanical Hardware Referring now to FIG. 3, which is an exploded view of a wrist watch built in accordance with this invention, it may be noted that the switch puts a multivibrator into a set condition, and this in turn causes the latch to hold the present timepiece output for the duration or readout.

At this point the timepiece output is connected to a word select network, which directs a readout command signal to the proper address in the memory matrix. This occurs in four stages, the first two for readout of the hour, the second two for minute readout.

For graphic illustration, the diagram of the watch has been made in terms of pictures of parts rather than in conventional electrical circuitry, because it is felt the pictures of the parts are the more graphic way of illustrating the watch.

In FIG. 3 the watch is shown in exploded style, wherein 30 represents the full body of the watch, 31, carried by strap segments, 32 and 33; opening, 34, is equipped with perforated cover, 35, and the side of the case carries switch, 36, for time demand and 37, for updating time.

To fix a speaker in place a "o" ring fits opening, 34, with perforated cover, 35, and mounted behind this is the speaker, 39, which is of generally conventional construction.

The electronic module, 40, is the heart of this construction and indicated therein are the chips, 41 and 42, which are the memory matrix connected to 43, which is the D/A converter, which in turn connects 44, 45, 46 and 47, which are the ladder network.

Connection is made to filter select, 49, which is also connected to the audio amplifier, 50. Aligning holes, 51 52, 53, 54, in the base of the module matrix, the inner cover, 55, and match the pins 56, 57, 58 and 59. The inner cover is adapted to receive crystal oscillator, 60, trimmer capacitor, 61, and the cell holder, 62, with energy cells 63 and 64. The entire package is held in place by the back case, 65. For holding the cells in place we provide terminal springs, 66, "o" rings, 67 and cell covers, 68, in conventional fashion, for holding these energy cells in openings provided.

The reverse side of the electronic module is shown in FIG. 3A. Herein, are the latch, the word select network, 70, control logic network, 71, divide chain, 72, and the digital clock timing chips, 73.

It will be seen from the foregoing that assembly of the watch, using commercially available parts becomes an exercise in the watchmaker's art on the basis of this design.

The same combination of parts can be built into the ear piece, as shown in FIG. 4. Here all parts are fitted together and moled, as in a pot, the speaker being oriented into the hearer's ear canal, as illustrated in the Figure. The time readout demand is accomplished by allowing for a flexible cover so that the user need merely press the unit to activate the readout when the unit is in place.

The same concept carries over to the spectacle frames and by placing the speaker near the end of the temple and, again, encasing the structure under a flexible bubble, the latch is made accessible to the finger where pressure quickly activates the unit to bring up a time signal.

Figure 6:
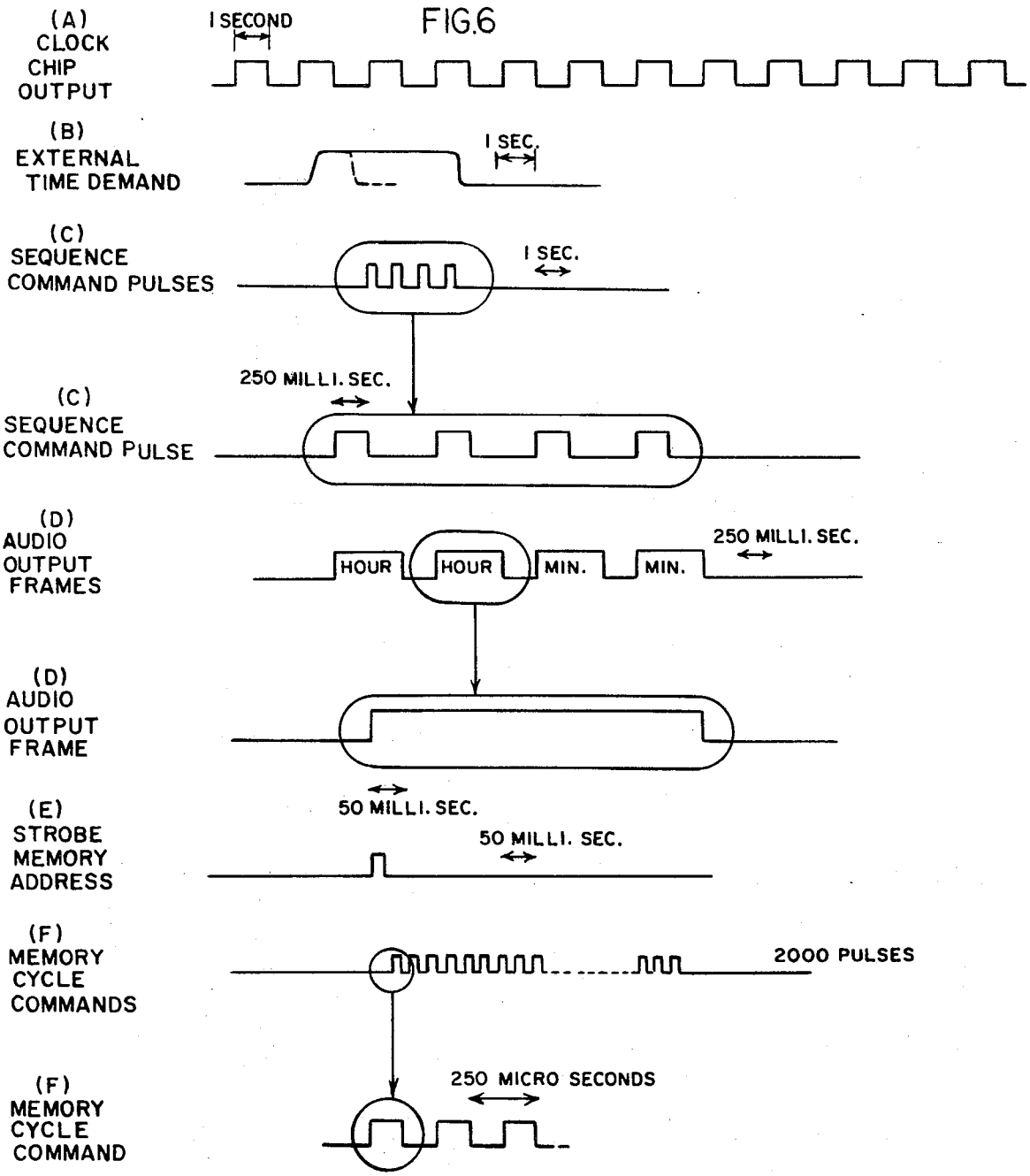
FIG. 6 is a waveform diagram.

FIG. 6 details the operation of the Digital Audio-Wrist Wrist Watch and should be read in conjunction with both the block diagram and FIG. 3.

The digital clock timing chip puts out a one-second nubmer (4 bits) whose least significant bit changes once every second (waveform (A)). The external time demand (waveform (B)) results when the time-demand button is depressed. This waveform is latched asynchronously by an RS Flip-Flop in the control circuit. Even though the time-demand button is released (see dotted portion of waveform (B)) the pulse remains until the entire audiotime message has been put out. No new time-output commands will be processed while a previous time-output cycle is in progress. During one time-demand pulse (waveform (B)) four sequence command pulses will be generated as shown in waveform (C). Each sequence command pulse leading edge forms the beginning of an audio output frame (waveform (D)). Each audio output frame lasts for 500 milliseconds. Two numbers will be put out for both hours and minutes. The 250 millisecond separation between audio-output frames serves to interject a short pause between the numbers put out. At the beginning of each audio-output frame a strobe memory address pulse (waveform (E) ) is generated by the control logic circuit and set to both the latch and word-select network. This pulse samples the latch for time content in terms of hours and minutes and forwards the information (4 bits) to the word-select network which interprets the number and steers the network to the appropriate block in the memory matrix where the digital equivalent of that particular number is stored as 2000 contiguous 4-bit words. The strobe memory address pulse (waveform (E) ) ten initiates 2000 memory cycle commands (wavefore (F) ) in the control logic circuit. Each of the memory cycle command pulses now initiates the transfer of each memory word from the memory matrix to the D/A converter until all 2000 4-bit words, which as a serial byte stream constitute one number (0 through 9, have been read out through the converter, filter, and audio-amplifier as one number. Each of these memory cycle command pulses has a repetition rate of slightly less than 250 microseconds (waveform (F) ).

The control logic block, as mentioned above, controls the entire sequencing of these waveforms. The timing signals described herein are synthesized by the divide chain which is fed from an oscillator in the 2 MHZ to 4 MHZ range. The exact choice of the oscillator frequency is strongly dependent upon which of the many off-the-shelf timing chips are chosen.

POWER DISSIPATION (ESTIMATED)

Standby: — 20 milliwatts (continuous)

*Voice mode: - 100 milliwatts (for 2 seconds — ½ second per digit)

*Note: Can be reclaimed by a solar cell if desired eliminating battery replacement.

NATURAL SOUNDING SYNTHESIZED VOICE

A technique has been achieved for digitizing and storing whole-words in Metal Oxide Semiconductor (MOS) Read-Only Memories (ROM). By analyzing plotted audio wave forms, it is possible to develop a conversion of analog audio signal of a word into a digital signal requiring minimal storage space.

The result of whole-word storage is that the synthesized voice is so natural sounding, it is difficult to distinguish it from the original. All of the voice inflections and natural qualities are there, so that one can actually recognize the person whose voice was used, even though the voice is reproduced electronically. With each word stored in its own individual memory, it is a simple matter to access each ROM and call up the words in the sequence required for the desired message. Simple logic decoding can be used to accomplish this sequencing without complicated programming.

Figure 7:
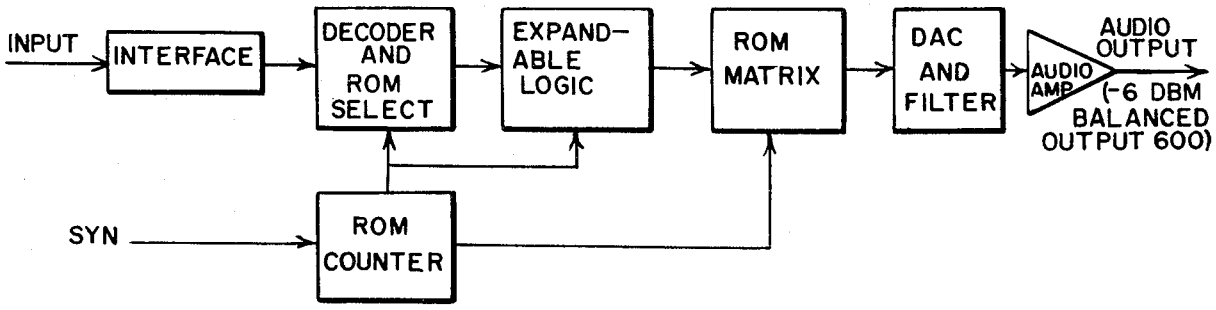
FIG. 7 is a functional block diagram showing voice synthesis and incorporates a commercially available MSC — Master Specialties Company voice synthesizer.
Figure 8:
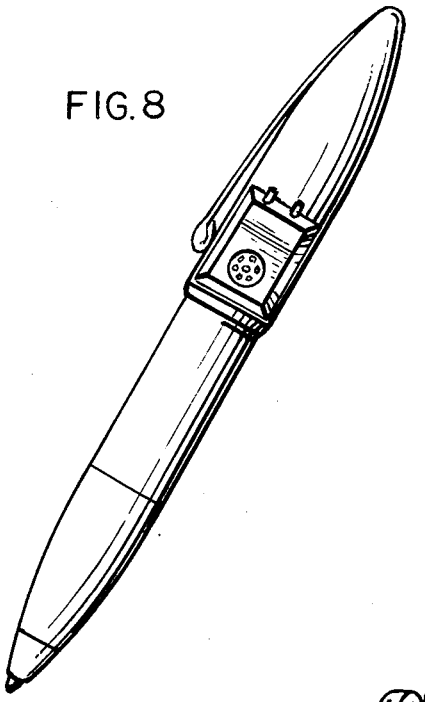
FIG. 8 illustrates the device built into a pen.
Figure 9:
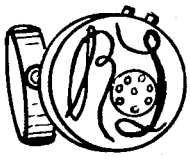
FIG. 9 illustrates the device formed as a cuff link.
Figure 10:
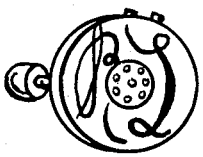
FIG. 10 illustrates the device as a tie tack.
Figure 11:
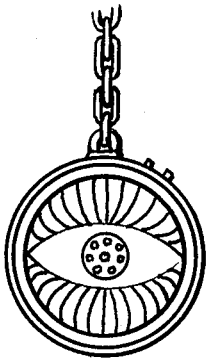
FIG. 11 illustrates the device as a pendant.
Figure 12:
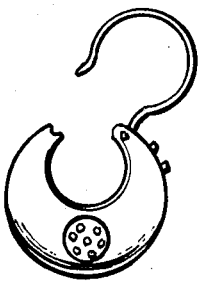
FIG. 12 illustrates the device as an earring.

More specifically the timepiece is shown in FIGS. 6 and in terms of waveforms related to the block diagram of FIG. 7 and the legends of FIG. 3.

It will be apparent from the foregoing that variations in the structure of the watch can be made without departing from the spirit of the invention. For example, the face surrounding the entire speaker can be made a solar cell to provide the energy to recharge the energy cells used to drive the mechanism. I have indicated time demand in the form of a small switch on the side of the case, with a similar switch for the updating of the time. These two functions are readily adaptable to control by centrifugal acceleration switches; that is, by providing an acceleration switch in the case in the circuit, the user can get his time readout by flicking his wrist and momentarily moving the watch to his ear to receive the time readout.

In this same vein, the mechanism is adapted to be mounted in a pen, cuff links, tie tacks, ladies' locket, ear rings, eye glasses frames, headgear, hats, etc., and any other mechanism of that personal nature.

In general the component parts of this watch may be purchased commercially from several different sources. For example, Litronics Corporation, Cupertino, Calif., is a source of LED chips and quartz crystals. Similarly, Texas Instruments of Dallas, Tex., Rockwell Manufacturing, Chicago, Ill., National Semiconductor Inc., Sunnyvale, Calif. and A.M.I. Inc., Mountain View, Calif., are sources of crystals and chips.

What is claimed is:

1. A timepiece comprising:

first means for generating time based signals, logic means coupled to said first means and being responsive to said time signals for selecting the proper combinations of said time signals which correspondingly indicate correct present time and for providing sequential outputs with intervals thereinbetween representing the proper combinations of said time signals, solid-state memory means having coded information command signals representing combinations of necessary verbal audio time phrases which correspond to said time signals, word selecting means interconnected to said logic and memory means and being responsive to said outputs of said logic means for directing said outputs of time base signals to proper locations in same memory means to thereby actuate said command signals representing verbal time phrases corresponding to the present time, and converting means coupled to said memory means for converting said command signals to signals which enable verbal readout.

2. A watch in accordance with claim 1 wherein the several means for selecting time signals are interconnected to respond to demand means externally available.

3. A watch in accordance with claim 2 in which the demand means is a switch.

4. A timepiece comprising:

first means for generating time based signals, logic means coupled to said first means and being responsive to said time signals for selecting the proper combinations of said time signals which correspondingly indicate correct present time and for providing sequential outputs with intervals thereinbetween representing the proper combinations of said time signals, solid-state memory means having coded information command signals representing combinations of necessary verbal audio time phrases which correspond to said time signals, word selecting means interconnected to said logic and memory means and being responsive to said outputs of said logic means for directing said outputs of time base signals to proper locations in said memory means to thereby actuate said command signals representing verbal time phrases corresponding to the present time, converting means coupled to said memory means for converting said command signals to signals which enable verbal readout, and verbal readout means coupled to said converting means for producing audio verbal tones.

* * * * *